United States Patent [19]

Pelissier

[11] Patent Number: 5,018,551

[45] Date of Patent: May 28, 1991

[54] DEVICE FOR INJECTING GAS UNDER HIGH PRESSURE AND HIGH FLOW RATE INTO AN AIRTIGHT TREATMENT CHAMBER AND FOR RECOVERY OF THE SAME

[75] Inventor: Laurent Pelissier, Grenoble, France

[73] Assignee: Etudes Et Constructions Mecaniques, Seyssinet, France

[21] Appl. No.: 494,362

[22] Filed: Mar. 16, 1990

[30] Foreign Application Priority Data

Mar. 17, 1989 [FR] France ..... 89 03795

[51] Int. Cl.[5] ..... B65B 3/14; B65B 3/16

[52] U.S. Cl. ..... 137/571; 141/66; 141/114

[58] Field of Search ..... 137/571; 141/65, 66, 141/67, 68, 114

[56] References Cited

U.S. PATENT DOCUMENTS

| | | | |
|---|---|---|---|
| 3,379,208 | 4/1968 | Alleaume | 137/571 X |
| 4,113,440 | 9/1978 | Klaasen | 137/571 X |
| 4,207,910 | 6/1980 | Müller | 137/571 X |
| 4,333,503 | 6/1982 | Stefiuk | 141/66 X |

FOREIGN PATENT DOCUMENTS

| | | | |
|---|---|---|---|
| 493278 | 5/1950 | Belgium | 137/571 |
| 2347415 | 4/1974 | Fed. Rep. of Germany | 137/571 |
| 8205061 | 7/1983 | Netherlands . | |
| 425852 | 3/1965 | Switzerland . | |
| 868246 | 5/1961 | United Kingdom . | |

*Primary Examiner*—John Rivell

*Attorney, Agent, or Firm*—Lowe, Price, LeBlanc, Becker & Shur

[57] ABSTRACT

A device provided for filling a treatment chamber (1) with a compressed gas and for evacuating gas present in the treatment chamber and storing the same includes a gas storage tank (2) that has a rigid tank (3) and an elastic tank (4) inside it, a first pipe (5) with a first valve (6) coupling the elastic tank to the chamber, a second pipe (11) coupling the elastic tank to the treatment chamber (1) through a pumping means (12), and compressed air inlet (9) for filling with compressed air a space (7) between the elastic tank (4) and the rigid tank (3), and a second valve (13) allowing space (7) to be vented.

4 Claims, 1 Drawing Sheet

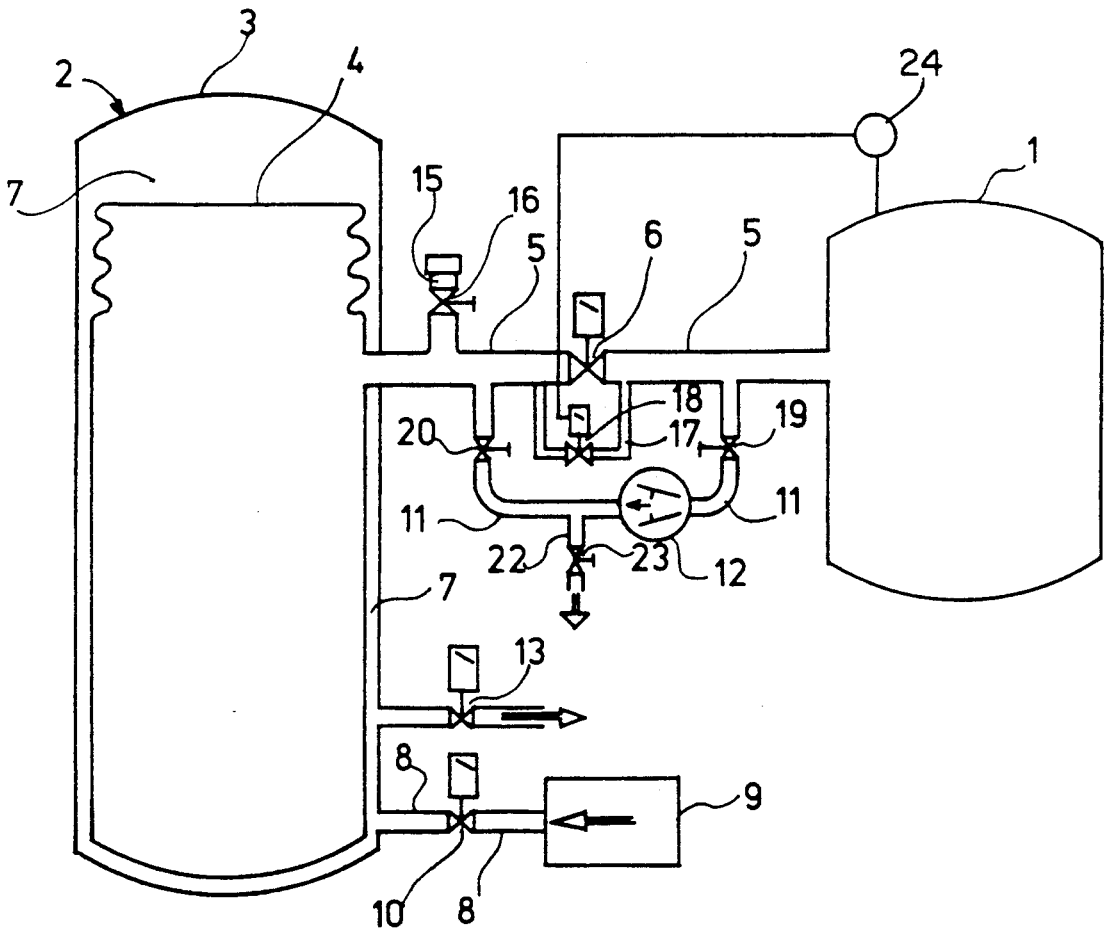
3
2
4
24
1
7
15
16
5
6
5
18
20
17
19
11
11
22
23
12
7
13
8
9
10
8

DEVICE FOR INJECTING GAS UNDER HIGH PRESSURE AND HIGH FLOW RATE INTO AN AIRTIGHT TREATMENT CHAMBER AND FOR RECOVERY OF THE SAME

FIELD OF THE INVENTION

The present invention relates to a device to fill a treatment chamber and to drain it off. The invention more particularly relates to a device to fill a treatment chamber with a compressed gas, to evacuate the gas present in the treatment chamber and to store it in order to reintroduce it into the treatment chamber in the next cycle.

BACKGROUND OF THE PRIOR ART

Some thermal treatments are carried out by arranging the parts to be treated in chamber and by injecting gas into this chamber. For example, hardening (gas-cooling) operations are achieved by introducing nitrogen under very high pressure then and then draining this gas off to open air at the end of each cycle.

In some hardening cycles, it is necessary to use more precious gases, such as helium, which permit cooling rates higher than those obtained with nitrogen. In this case, but also in many other treatments using a gas in a treatment chamber, it is necessary to recover the gas extracted from the treatment chamber in order to use it again during the next treatment cycle. The treatment gas is thus recovered for economical reasons if it is expensive, or for safety reasons if this gas is toxic or dangerous.

When a gas under a relatively high pressure has to be injected into a treatment chamber, it is necessary to use a relatively large-size pumping means in order to pump the gas from a storage tank to the treatment chamber. The same pumping means or another large-size pumping means is used to pump the gas out of the treatment chamber to carry it to the storage tank.

In some applications, it is desirable that the time taken for filling the chamber and draining it off be relatively short. In such case, the pumping means used (compressors) have to transfer very high gas flows and bring the gas to a relatively high pressure. On the other hand, the nature of the gases used can be such that pumping presents problems, for example if the gases are corrosive.

SUMMARY OF THE INVENTION

The invention therefore provides a device allowing a gas to be transferred from a storage tank to a treatment chamber using, as an auxiliary element only, a gas pumping means which requires a relatively low pumping capacity.

More particularly, the invention provides a device to fill a treatment chamber with a compressed gas, to evacuate the gas present in the treatment chamber and to store it, comprising a gas storage tank means including a rigid tank and an elastic tank arranged inside the rigid tank; a first pipe coupling the elastic tank to the treatment chamber through a first valve, a second pipe connecting the treatment chamber to the elastic tank, this second pipe comprising a pumping means for pumping gas from the treatment chamber to the elastic tank; means for filling the space between the elastic tank and the rigid tank with compressed air; and a second valve to vent the space between the elastic tank and the rigid tank. The treatment chamber is filled by introducing compressed air into the space between the elastic tank and the rigid tank. Then by opening the first valve the treatment chamber is drained off by opening the first and second valve, then by closing the first valve and draining the residual gas present in the treatment chamber, by means of the pumping means, towards the elastic tank.

BRIEF DESCRIPTION OF THE DRAWINGS

The foregoing and other related objects, features and advantages of the invention will be apparent from the following detailed description of a preferred embodiment as illustrated in FIG. 1 which schematically represents a device according to the invention.

DESCRIPTION OF THE PREFERRED EMBODIMENT

FIG. 1 illustrates a treatment chamber 1 and a storage tank 2. The treatment chamber 1 is an airtight rigid chamber that can be opened to allow parts that are to be treated to be introduced, and to be closed thereafter to allow a treatment step to be carried out. Generally, the treatment chamber 1 is first evacuated, a treatment gas is injected as quickly as possible at a relatively high pressure. In the case of a hardening process, it may be necessary to introduce into the treatment chamber 1 some helium, for example at under $5.10^5$Pa.

The storage tank 2 is formed of a rigid tank 3 and an elastic tank 4 arranged inside the rigid tank. The elastic tank 4 forms an airtight chamber having a varying volume, which is, for example, delimited by a flexible wall made of an elastic material of an elastomer type or by a structure having sliding bellows.

A first pipe 5 provided with a controlled valve 6 couples the inner part of elastic tank 4 to the inner part of airtight chamber 1.

Space 7, arranged between rigid tank 3 and elastic tank 4, communicates by means of a pipe 8 with a means 9 supplying compressed air. In pipe 8 is inserted a controlled valve 10.

A second pipe 11 couples elastic tank 4 to airtight chamber 1 and comprises a pumping means 12 designed to pump gas from airtight chamber 1 to transfer it into elastic tank 4.

A valve 13 allows space 7 to be vented.

Referring to the above-described elements, the general operation of the device is as follows. Airtight chamber 1 is filled by introducing compressed air through compressed air intake port 9 into space 7 arranged between rigid tank 3 and elastic tank 4 and then opening the first valve 6. Evacuation of airtight chamber 1 is achieved by opening valves 6 and 13, then closing valve 6 and pumping towards elastic tank 4 the residual gas present in airtight chamber 1 by means of a pumping device 12.

In order to inject a gas into airtight chamber 1 at a $5.10^5$ Pa pressure, compressed air, for example from a compressed air network, has to be applied to pipe 8 at a pressure higher than $5.10^5$ Pa determined as a function of the relative volumes of storage tank 2 and airtight chamber 1, with valve 6 opened. Gas is naturally and quickly transferred from elastic tank 4 to airtight chamber 1 without resorting to pumping means In order to evacuate airtight chamber 1, it is merely necesarry to vent space 7 by opening valve 13 and to open valve 6. Under these conditions, the compressed air present in airtight chamber 1 naturally enters elastic tank 4 until its pressure in airtight chamber 1 approaches the atmospheric pressure. If the gas in airtight chamber 1 is initially at a $5.10^5$ Pa pressure, the largest part of the gas is automatically evacuated into elastic tank 4 without resorting to any pumping means. In order to fully evacuate airtight chamber 1, it is merely necessary to close valve 6 and to operate pumping means 12. Pumping means 12 is in fact constituted by a vacuum pump, the pumping rate of which needs not be very high since the greatest part of the gas has been previously transferred.

The device according to the invention further comprises a means for initially transferring a selected gas into elastic tank 4. This means (not shown) routes this gas through a pipe 15 and a valve 16 in pipe 5 arranged between elastic tank 4 and valve 6. Additionally, a small diameter-pipe 17 is provided in parallel to valve 6, comprising a valve 18. In pipe 11, upstream and downstream of pump 12, are respectively arranged a valve 19 and a valve 20. Also, a vent 22 is provided in pipe 11, at the output of pump 12, to be closed by a valve 23.

Considering all the above-described elements, the operation of the whole device is explained as follows:

(1) Valves 10, 16, 18 and 20 are closed and valves 6, 13, 19 and 23 are opened. The elastic tank 4 and airtight chamber 1 are evacuated by the vacuum pump 12.

(2) Valve 16 is opened and valve 6 is closed in order to fill elastic tank 4 with gas at a pressure slightly higher than the atmospheric pressure, elastic tank 4 then occupying the volume of rigid tank 3.

(3) Valves 13, 16, 19 and 23 are closed and valve 10 is opened. Then by means of a compressor or a compressed gas or air tank, or from an external compressed air network, compressed air is blown into space 7 for compressing elastic tank 4 in order to bring the gas contained in elastic tank 4 to a pressure sufficiently higher than the one it is desired to have in airtight chamber 1. The difference in pressure to be applied determines the filling rate of airtight chamber 1, so that, at the end of the transfer of the gas from elastic tank 4 into airtight chamber 1 through valve 6, pressure in rigid tank 3 is at least equal to the desired pressure in airtight chamber 1. Moreover, it will be possible to determine that, at the end of the filling operation, the pressure in tank 3 is higher than the one it is desired to have in airtight chamber 1 and to provide a gas reserve in elastic tank 4; the filling of airtight chamber 1 is then interrupted at the desired pressure by closing valve 6. Additional gas can be transferred during treatment by closing valve 6 and opening valve 18, allowing gas to flow in small diameter valve 17, valve 18 being controlled by a pressure measurement means 24 arranged so that the pressure measurement means controls the opening of the seventh valve 18 if the pressure in the treatment chamber 1 is lower than a first predetermined pressure and controls the closing of seventh valve 18 if the pressure in the treatment chamber is higher than a second predetermined pressure.

(4) Valves 6, 10, 18 being closed, treatment in airtight chamber 1 can be carried out.

(5) When treatment is completed, in order to evacuate airtight chamber 1, the venting valve 13 is opened, then valve 6 is opened. The gas which is at a pressure higher than the atmospheric pressure flows back into elastic tank 4 and is again at a pressure close to atmospheric pressure.

(6) Valve 6 is then closed and valves 19 and 20 are opened, then airtight chamber 1 is evacuated into elastic tank 4 by means of vacuum pump 12.

(7) When the cycle is completed, valves 13, 19 and 20 are closed and a new cycle such as described in (3) can then be started.

At any time, the initial quantity of helium or other gas contained in elastic tank 4 can be restored by supplying additional gas by means of valve 16. In this disclosure, there is shown and described only the preferred embodiment of the invention, but, as aforementioned, it is to be understood that the invention is capable of use in various other combinations and environments and is capable of changes or modifications within the scope of the inventive concept as expressed herein.

I claim:

1. A device for filling a treatment chamber with a compressed gas, for evacuating gas present in the treatment chamber and for storing the evacuated gas, comprising:

a gas storage tank comprising a rigid tank and an elastic tank arranged inside the rigid tank;

a first pipe coupling said elastic tank to said treatment chamber, said first pipe comprising a first valve;

a second pipe coupling said elastic tank to said treatment chamber, said second pipe comprising a pumping means for pumping gas from the treatment chamber to the elastic tank;

a compressed air inlet for filling with compressed air a space arranged between the elastic tank and the rigid tank; and a second valve allowing said space to be vented, said treatment chamber being filled by introducing compressed ait into said space, and then opening the first valve, and said treatment chamber being evacuated by opening the first and second valves and then closing the first valve and evacuating with the pumping means towards the elastic tank residual gas present in said treatment chamber.

2. A device according to claim 1, further comprising:

a third valve arranged in the second pipe upstream of the pumping means and a fourth valve arranged in the second pipe downstream of the pumping means and a venting pipe, arranged on the second pipe downstream of the pumping means and upstream of the fourth valve, said venting pipe being provided with a a fifth valve for enabling evacuation of said elastic tank and said treatment chamber by operation of the pumping means and by opening of the first valve, the third valve and the fifth valve and closing of the fourth valve.

3. A device according to claim 1, further comprising:

means for suplying gas to the elastic tank by conveying this gas through a third pipe comprising a sixth valve opening into the first pipe between the elastic tank and the first valve.

4. A device according to claim 1, further comprising:

means for measuring a pressure in said treatment chamber, a fourth pipe connected in parallel to said first pipe across said first valve therein, said fourth pipe comprising a seventh valve controlled by said pressure measurement means, whereby when the first valve is closed during a treatment operation carried out in said treatment chamber, the pressure measurement means controls the opening of the seventh valve if the pressure in the treatment chamber is lower than a predetermined first pressure and controls the closing of the seventh valve if the pressure in the treatment chamber is higher than a predetermined second pressure.

* * * * *